US006401281B1

(12) United States Patent
Younge

(10) Patent No.: US 6,401,281 B1
(45) Date of Patent: Jun. 11, 2002

(54) BED RAIL PADS

(76) Inventor: Josephine L. Younge, 238 Ridgecrest Dr., San Diego, CA (US) 92114-7236

( * ) Notice: Subject to any disclaimer, the term of this patent is extended or adjusted under 35 U.S.C. 154(b) by 0 days.

(21) Appl. No.: 09/732,550

(22) Filed: Dec. 8, 2000

(51) Int. Cl.[7] ..... A47C 31/00
(52) U.S. Cl. ..... 5/663; 5/425; 5/427
(58) Field of Search ..... 5/663, 424, 425, 5/427

(56) References Cited

U.S. PATENT DOCUMENTS

| | | | | | |
|---|---|---|---|---|---|
| 3,430,272 | A | * | 3/1969 | Thorn, Jr. | 5/663 |
| 3,742,530 | A | | 7/1973 | Clark | |
| 3,949,435 | A | * | 4/1976 | Dionne | 5/663 |
| 4,767,419 | A | * | 8/1988 | Fattore | 5/424 |
| D299,393 | S | | 1/1989 | Sands | |
| 5,044,025 | A | | 9/1991 | Hunsinger et al. | |
| 5,191,663 | A | | 3/1993 | Holder et al. | |
| 5,241,718 | A | * | 9/1993 | Pope | 5/424 |
| 5,437,071 | A | * | 8/1995 | Feigenbaum | 5/663 |
| 5,450,641 | A | * | 9/1995 | Montgomery | 5/663 |
| 5,557,817 | A | | 9/1996 | Haddock | |
| 5,566,407 | A | * | 10/1996 | Lien | 5/663 |
| 5,700,053 | A | * | 12/1997 | Downing | 297/227 |
| 5,749,112 | A | | 5/1998 | Metzler | |
| 6,055,690 | A | * | 5/2000 | Koenig | 5/424 |
| 6,076,212 | A | * | 6/2000 | Feld | 5/663 |
| 6,170,101 | B1 | * | 1/2001 | McCloud | 5/424 |

* cited by examiner

*Primary Examiner*—Jack Lavinder
*Assistant Examiner*—James M. Hewitt

(57) ABSTRACT

A bed rail pad for protecting a user from bed rails and for keeping items on a bed includes a plurality of pads. Each of the pads is elongated and has a generally tubular shape. The pads have open first and second ends. The pads each have an elongated slit therethrough extending between the first and second ends such that a first edge and a second edge are defined. Each of a plurality of panels has a peripheral edge. A plurality of fastening means removably fastens the pads to the panels. The pads may be positioned around a railing such that the panels may be removably coupled to the pads and the panels may extend between spaced railings.

8 Claims, 2 Drawing Sheets

FIG. 4
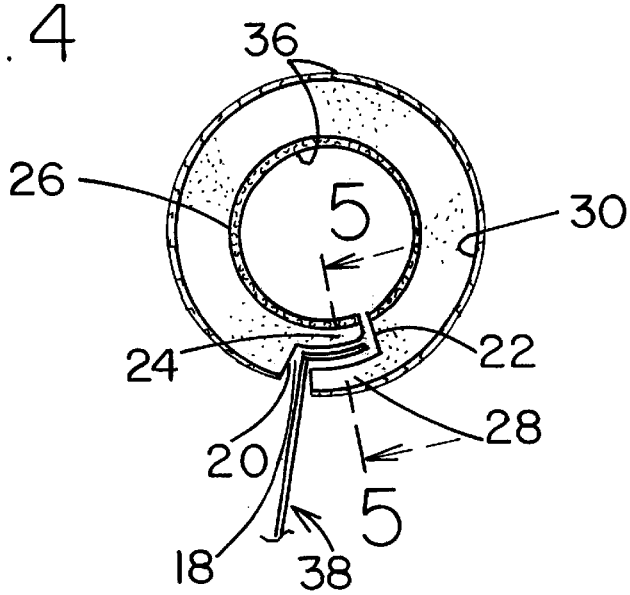
FIG. 5
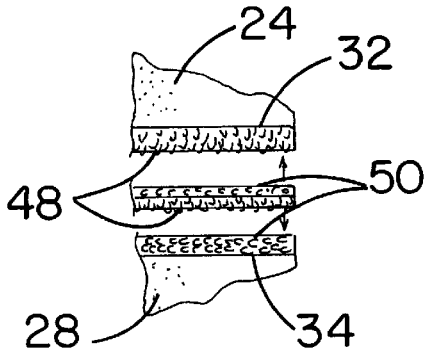
FIG. 6
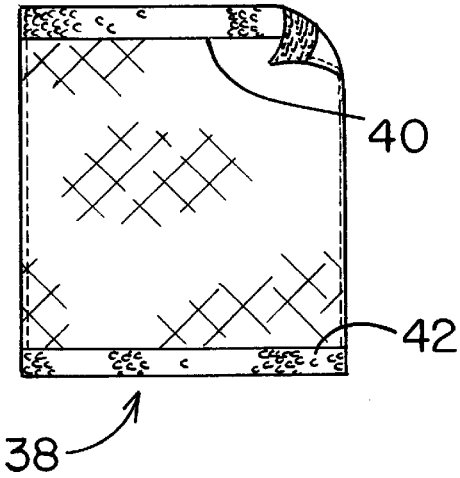
FIG. 7
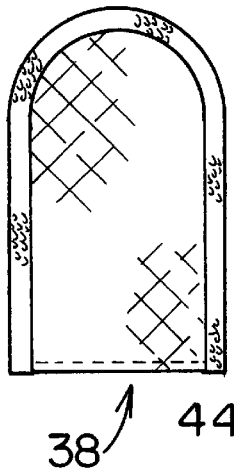
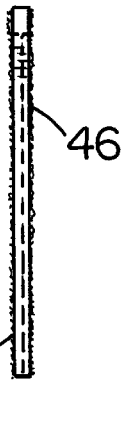
FIG. 8

BED RAIL PADS

BACKGROUND OF THE INVENTION

1. Field of the Invention

The present invention relates to padding for rails and more particularly pertains to a new bed rail pad for protecting a user from bed rails and for keeping items on a bed.

2. Description of the Prior Art

The use of padding for rails is known in the prior art. More specifically, padding for rails heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,742,530; U.S. Pat. No. 5,044,025; U.S. Pat. No. 5,191,663; U.S. Pat. No. 5,557,817; U.S. Pat. No. 5,749,112; and U.S. Des. Pat. No. 299,393.

While these devices fulfill their respective, particular objectives and requirements, the aforementioned patents do not disclose a new bed rail pad which includes a tubular pad member and netting extending between pad members to form a barrier.

the bed rail pads according to the present invention substantially departs from the conventional concepts and designs of the prior art, and in so doing provides an apparatus primarily developed for the purpose of protecting a user from bed rails and for keeping items on a bed.

SUMMARY OF THE INVENTION

In view of the foregoing disadvantages inherent in the known types of padding for rails now present in the prior art, the present invention provides a new bed rail pad construction wherein the same can be utilized for protecting a user from bed rails and for keeping items on a bed.

The general purpose of the present invention, which will be described subsequently in greater detail, is to provide a new bed rail pads apparatus and method which has many of the advantages of the padding for rails mentioned heretofore and many novel features that result in a new bed rail pads which is not anticipated, rendered obvious, suggested, or even implied by any of the prior art padding for rails, either alone or in any combination thereof.

To attain this, the present invention generally comprises a plurality of pads. Each of the pads has a generally tubular shape. Each of the pads is elongated and has a first end and a second end. Each of the first ends and the second ends is open. Each of the pads has an elongated slit therethrough that extends between the first and second ends such that a first edge and a second edge are defined. The first edges have an elongated lip coupled thereto. Each of the elongated lips extends between the first and second ends and is positioned generally adjacent to an inner surface of the pad. Each of the second edges has an elongated flange coupled thereto. Each of the elongated flanges extends between the first and second ends and is positioned generally adjacent to an outer surface of the pad. An outer surface of each of the elongated lips may be abutted against an inner surface of a respective elongated flange. A plurality of fastening means removably fasten lips to the flanges.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bed rail pad apparatus and method which has many of the advantages of the padding for rails mentioned heretofore and many novel features that result in a new bed rail pad which is not anticipated, rendered obvious, suggested, or even implied by any of the prior art padding for rails, either alone or in any combination thereof.

It is another object of the present invention to provide a new bed rail pad which may be easily and efficiently manufactured and marketed.

It is a further object of the present invention to provide a new bed rail pad which is of a durable and reliable construction.

An even further object of the present invention is to provide a new bed rail pad which is susceptible of a low cost of manufacture with regard to both materials and labor, and which accordingly is then susceptible of low prices of sale to the consuming public, thereby making such bed rail pads economically available to the buying public.

Still yet another object of the present invention is to provide a new bed rail pad which provides in the apparatuses and methods of the prior art some of the advantages thereof, while simultaneously overcoming some of the disadvantages normally associated therewith.

Still another object of the present invention is to provide a new bed rail pad for protecting a user from bed rails and for keeping items on a bed.

Still yet another object of the present invention is to provide new bed rail pads that are retrofittable to existing bed railings.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a schematic exploded end view of the present invention.

FIG. 5 is a schematic cross-sectional view taken along line 5—5 of the present invention.

FIG. 6 is a schematic plan view of a panel of the present invention.

FIG. 7 is a schematic plan view of a panel of the present invention.

FIG. 8 is a schematic side view of FIG. 7 of the present invention.

DESCRIPTION OF THE PREFERRED EMBODIMENT

Figure 1:
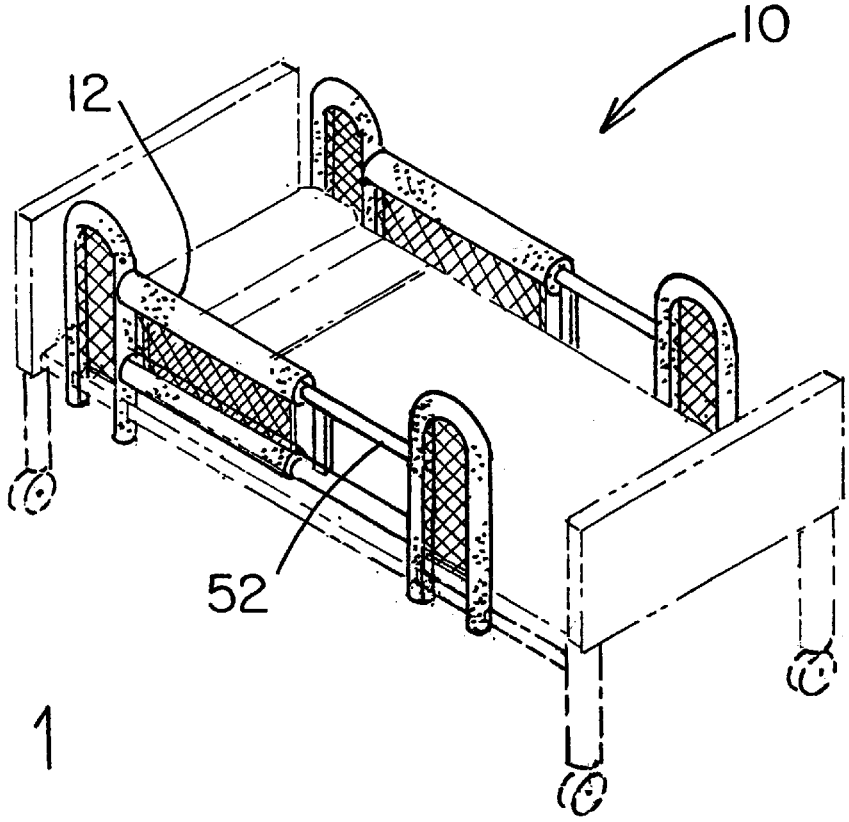
FIG. 1 is a schematic perspective in use view of a new bed rail pad according to the present invention.
Figure 2:
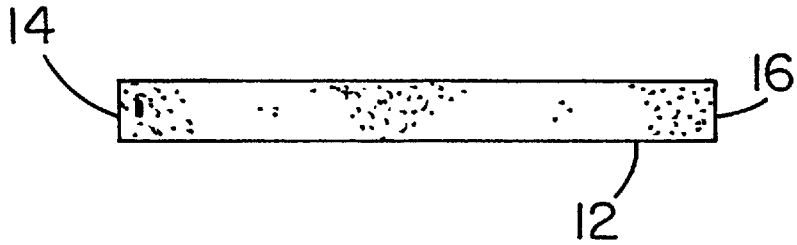
FIG. 2 is a schematic side view of the present invention.
Figure 3:
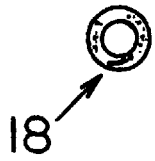
FIG. 3 is a schematic end view of the present invention showing the slit.

With reference now to the drawings, and in particular to FIGS. 1 through 8 thereof, a new bed rail pad embodying the principles and concepts of the present invention and generally designated by the reference numeral 10 will be described.

As best illustrated in FIGS. 1 through 8, the bed rail pads 10 generally comprises a plurality of pads 12. Each of the pads 12 has a generally tubular shape. Each of the pads 12 is elongated and has a first end 14 and a second end 16. The first ends 14 and the second ends 16 are each open. The pads 12 each have an elongated slit 18 therethrough and extending between the first and second ends such that a first edge 20 and a second edge 22 are defined. Each of the first edges 20 has an elongated lip 24 coupled thereto. The elongated lips 24 extend between the first 14 and second 16 ends and are positioned generally adjacent to an inner surface 26 of the pad 12. Each of the second edges 22 has an elongated flange 28 coupled thereto extending between the first 14 and second 16 ends and being positioned generally adjacent to an outer surface 30 of the pad 12. An outer surface 32 of each of the elongated lips 24 may be abutted against an inner surface 34 of a respective elongated flange 28. Each of the pads 12 preferably comprises a foamed elastomeric material. The elastomeric material frictionally engages an associated bed railing 52 when abutted against it. A cloth material 36 generally covers each of the inner 26 and outer 32 surfaces of the pads 12. The cloth material 36 is ideally non-porous.

Each of a plurality of panels 38 is preferably comprised of a woven netting material. Each of the panels 38 has a peripheral edge 40. Each of a plurality of strips 42 is securely attached to one of the peripheral edges 40 of the panels 38. Each of the strips 42 has a front side 44 and a backside 46.

A plurality of fastening means removably fastens the pads 12 to the panels 38. Each of the fastening means comprises a hook and loop fastening means. A hook portion 48 is securely coupled to each of the outer surfaces 32 of the elongated lips 24 and the front sides 44 of the strips 42. A loop portion 50 is securely coupled to each of the inner surfaces 34 of the elongated flanges 28 and the back sides 46 of the strips 42. Also envisioned are zipper or button fasteners in place of the hook and loop fasteners.

In use, the pads 12 may be positioned around a railing 52 such that the panels 42 may be removably coupled to the pads. The panels then extend between spaced railings 52. The pads protect a user from the railings and the netting ensures that items remain on the bed. As shown in FIG. 1 and 7, the tubular members and panels may have a U-shape for fitting around U-shaped railings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cushioning system, said system being removably positionable on bed, railing, said system comprising:

a plurality of pads, each of said pads having a generally tubular shape, each of said pads being elongated and having a first end and a second end, each of said first ends and said second ends being open, each of said pads having an elongated slit therethrough and extending between said first and second ends such that a first edge and a second edge are defined, each of said first edges having an elongated lip coupled thereto, each of said elongated lips extending between said first and second ends and being positioned generally adjacent to an inner surface of said pad, each of said second edges having an elongated flange coupled thereto, each of said elongated flanges extending between said first and second ends and being positioned generally adjacent to an outer surface of said pad, wherein an outer surface of each of said elongated lips may be abutted against an inner surface of a respective elongated flange;

a plurality of panels, each of said panels comprising a netting material, each of said panels having a peripheral edge;

a plurality of strips, each of said strips being securely attached to one of said the peripheral edges of said panels, each of said strips having a front side and a backside; and a plurality of fastening means for removably fastening said pads to said panels, each of said fastening means including a hook portion being securely coupled to each of said outer surfaces of said elongated lips and said front sides of said strips and a loop portion being securely coupled to each of said inner surfaces of said inner surfaces of said elongated flanges and said back sides of said strips.

2. The cushioning system as in claim 1, further comprising a cloth material covering each of said inner and outer surfaces of said pads.

3. The cushioning system as in claim 1, wherein each of said pads has a U-shape.

4. A cushioning system, said system being removably positionable on a bed railing, said system comprising:

a plurality of pads, each of said pads having a generally tubular shape, each of said pads being elongated and having a first end and a second end, each of said first ends and said second ends being open, each of said pads having an elongated slit therethrough and extending between said first and second ends such that a first edge and a second edge are defined, each of said first edges having an elongated lip coupled thereto, each of said elongated lips extending between said first and second ends and being positioned generally adjacent to an inner surface of said pad, each of said second edges having an elongated flange coupled thereto, each of said elongated flanges extending between said first and second ends and being positioned generally adjacent to an outer surface of said pad, wherein an outer surface of each of said elongated lips may be abutted against an inner surface of a respective elongated flange, each of said pads comprising a foamed elastomeric material, each of said inner and outer surfaces of said pads being generally covered by a cloth material;

a plurality of panels, each of said panels comprising a netting material, each of said panels having a peripheral edge;

a plurality of strips, each of said strips being securely attached to one of said the peripheral edges of said panels, each of said strips having a front side and a backside;

a plurality of fastening means for removably fastening said pads to said panels, each of said fastening means including a hook portion being securely coupled to each of said outer surfaces of said elongated lips and said front sides of said strips and a loop portion being securely coupled to each of said inner surfaces of said elongated flanges and said back sides of said strips; and wherein the pads may be positioned around a railing such that the panels may be removably coupled to the pads and the panels may extend between spaced railings.

5. A cushioning system, said system being removably positionable on a bed railing, said system comprising:

a plurality of pads, each of said pads having a generally tubular shape, each of said pads being elongated and having a first end and a second end, each of said first ends and said second ends being open, each of said pads having an elongated slit therethrough and extending between said first and second ends such that a first edge and a second edge are defined;

a plurality of panels, each of said panels having a peripheral edge;

a plurality of fastening means for removably fastening said pads to said panels; and wherein the pads may be positioned around a railing such that the panels may be removably coupled to the pads and the panels may extend between spaced railings.

6. The cushioning system as in claim 5, wherein a each of said first edges of said pads has an elongated lip coupled thereto, each of said elongated lips extending between said first and second ends and being positioned generally adjacent to an inner surface of said pad, each of said second edges having an elongated flange coupled thereto, each of said elongated flanges extending between said first and second ends and being positioned generally adjacent to an outer surface of said pad, wherein an outer surface of each of said elongated lips may be abutted against an inner surface of a respective elongated flange.

7. The cushioning system as in claim 5, wherein each of said panels comprises a netting material.

8. The cushioning system as in claim 6, further including:

a plurality of strips, each of said strips being securely attached to one of said the peripheral edges of said panels, each of said strips having a front side and a backside;

each of said fastening means including a hook portion being securely coupled to each of said outer surfaces of said elongated lips and said front sides of said strips and a loop portion being securely coupled to each of said inner surfaces of said elongated flanges and said back sides of said strips.

* * * * *